United States Patent [19]

Larson

[11] Patent Number: 4,737,201

[45] Date of Patent: Apr. 12, 1988

[54] SOLUTION HEAT TREATMENT OF ENGINE POPPET VALVES AND VALVES MADE THEREFROM

[75] Inventor: Jay M. Larson, Marshall, Mich.

[73] Assignee: Eaton Corporation, Cleveland, Ohio

[21] Appl. No.: 923,665

[22] Filed: Oct. 27, 1986

[51] Int. Cl.[4] ..... C21D 1/26; F01L 3/02

[52] U.S. Cl. ..... 148/11.5 R; 148/145; 148/149; 148/902; 148/320; 148/426; 123/188 AA

[58] Field of Search ..... 148/134, 142, 145, 149, 148/902, 903, 11.5 R, 11.5 N, 12 R, 12 E, 320, 426, 146, 162, 158, 326, 328, 405, 409, 410; 123/188 AA; 428/610, 611

[56] References Cited

U.S. PATENT DOCUMENTS

| | | | |
|---|---|---|---|
| 1,720,353 | 7/1929 | Schneider et al. | 148/902 |
| 2,073,178 | 3/1937 | Rich | 123/188 AA |
| 2,170,267 | 8/1939 | Rich | 123/188 AA |
| 2,246,078 | 6/1941 | Rohn et al. | 148/902 |
| 2,734,008 | 2/1956 | Kirkpatrick et al. | 148/11.5 N |
| 2,888,373 | 9/1956 | Cherrie et al. | 148/21.54 |
| 3,286,704 | 11/1966 | Danis | 123/188 AA |
| 3,461,001 | 8/1969 | Kubera | 148/11.5 R |
| 3,503,375 | 3/1970 | Thompson | 123/188 AA |
| 3,536,053 | 10/1970 | Vitcha et al. | 123/188 AA |
| 3,607,461 | 9/1971 | Stanley et al. | 123/188 AA |
| 4,345,950 | 8/1982 | O'Hara | 148/11.5 N |
| 4,547,229 | 10/1985 | Larson et al. | 148/145 |

*Primary Examiner*—John J. Zimmerman

*Attorney, Agent, or Firm*—D. A. Rowe; A. E. Chrow

[57] ABSTRACT

An engine poppet valve is manufactured to have a microstructure that varies by location to match the stresses, temperature, wear and other conditions encountered in service. The microstructure is characterized by a coarse grain size in the head adjacent its combustion face, a fine grain size in the head adjacent its seat face, and a fine grain size in the stem.

5 Claims, 1 Drawing Sheet

SOLUTION HEAT TREATMENT OF ENGINE POPPET VALVES AND VALVES MADE THEREFROM

DESCRIPTION

TECHNICAL FIELD

The present invention relates generally to engine poppet valves, and more specifically to a new and improved rapid selective solution treatment process that makes it possible to control the microstructure by location within an engine valve to match the stresses, temperature and other operating conditions experienced in service.

BACKGROUND ART

The physical properties which are important in engine poppet valve applications include high temperature creep and fatigue strengths in the head which is the portion of the valve that is subjected to the high operating temperatures of the combustion chamber, and good wear resistance and low temperature fatigue and tensile strengths in the stem near the keeper groove. In some applications the seating surfaces of the valve are required to have good impact strength or hot hardness.

In making valves from the many austenitic alloys that are available, a conventional practice has been to solution heat treat the valves in a batch process. The conventional solution heat treatment process has several disadvantages. When the time and temperature are selected to achieve a microstructure having a large grain size for optimum high temperature properties in the head, there is a sacrifice of low temperature properties in the stem. Conversely, when the time and temperature of heat treatment are selected to achieve good low temperature properties in the stem, it is not possible to obtain the best high temperature properties in the head. Batch type solution treatment processes tend to cause distortion of the valve stems which makes it necessary to employ an additional roll straightening operation. Another disadvantage is that it is usually necessary to completely age the valves after solution treatment in order to avoid strain-age cracking associated with roll straightening of the stems. Still other disadvantages of the conventional batch type solution heat treatment process include the need for an endothermic atmosphere, the processing time that is required, and a general inability to achieve a consistent microstructure from valve to valve.

U.S. Pat. No. 4,547,229, issued Oct. 15, 1985 for Solution Heat Treating of Engine Poppet Valves, the disclosure of which is incorporated by reference, discloses a rapid selective solution treatment process that offers several advantages over the batch type operation in improving product performance characteristics. A primary feature of the novel process disclosed in the patent is the ability to selectively solution treat the head section of the valve to optimize high temperature creep and fatigue strengths, while maintaining a fine grained microstructure in the cooler running portion of the stem. The location of a transition zone between the fine grain size of the stem and the coarser grain size of the head can be adjusted axially based on the temperature profile of the valve in a given engine application and the mechanical property characteristics of the alloy employed. In one preferred application, a coarse grain size in a range from about ASTM 2 to 5 is developed in the head to achieve the desired high temperature creep and fatigue strengths, and a fine grain size of about ASTM 8 or finer is maintained in the valve stem for low temperature toughness.

The rapid selective solution treatment process disclosed in U.S. Pat. No. 4,547,229 offers several other product advantages: a more consistent microstructure at each location from valve to valve and greatly reduced occurrence of distortion and anomalies such as secondary recrystallization and dealloying. The process is rapid, automatable, energy efficient and provides flexibility to solution treat either an as-forged or semi-finished part. The flexibility inherent in the process allows for in-line processing instead of the typical batch heat treatment.

In some heavy duty service engine applications, the seating surfaces of the valve heads are required to have increased hardness at elevated temperatures and resistance to corrosion. These properties typically have been provided by applying hard facing to the seating surfaces. In a processing sequence conventionally used for two-piece seat welded valves, the seat welding operation follows the solution treatment and precipitation hardening of the base metal. The microstructural characteristics of the base metal in the heat affected zone are altered with an associated potential degradation of fatigue properties.

With the use of the rapid selective solution treatment process of U.S. Pat. No. 4,547,229, it is possible to reverse the sequence of operations so that the base metal is heat treated after seat welding. This results in an improvement of the mechanical properties of the material in the heat affected zone.

The purpose of the present invention is to provide an improvement in the rapid selective solutioning process of U.S. Pat. No. 4,547,229 which makes it possible to increase both hot hardness and corrosion resistance of the seating surfaces of valves without applying hard facing in a seat welding operation. More particularly, the invention makes it possible to retain a fine grain size, e.g., ASTM 8 or finer, from forging in the valve head area adjacent to the seat face, while still developing the optimum microstructure in the rest of the valve during rapid selective solution treatment.

DISCLOSURE OF THE INVENTION

The invention provides a solution heat treated poppet valve comprising a forged head and a forged stem, the valve being characterized by a microstructure which is controlled by location to match stresses and temperatures encountered in service. The microstructure includes a fine grain size in the stem for low temperature toughness, a coarse grain size in the head adjacent its combustion face for high temperature creep and fatigue strengths, a transition zone between the coarse grain size of the head and the fine grain size in the stem, and a fine grain size in the portion of the head adjacent its seat face for high temperature hardness and corrosion resistance. In a particularly preferred embodiment, the fine grain size in the stem and in the head adjacent the seat face is ASTM 8 or finer, while the coarse grain size of the head adjacent the combustion face is in a range of from about ASTM 2 to 5.

The invention also provides a method of making poppet valves comprising the steps of forging a poppet valve from a slug sheared from a wrought bar, solution heat treating the head of the valve to produce a coarse grain size adjacent the combustion face for high temperature fatigue and creep strengths, and maintaining a fine grain size from forging in the stem of the valve and the portion of the head adjacent the seat face for low temperature toughness, wear resistance, and hot hardness. The step of solution heat treating the head can be carried out by radiant heating in a continuous manner, while preventing the temperature of the valve material in the stem and in the portion of the head adjacent the seat face from getting high enough to result in significant grain growth.

A further understanding of the invention will be apparent from the following detailed description and the accompanying drawing.

BEST MODE FOR CARRYING OUT THE INVENTION

The process of the invention is applicable to the many commercially used valve materials that are normally solution heat treated. As will be recognized by those familiar with the art of valve making, such materials include the austenitic steels of the S.A.E.EV series and similar compositions. The invention is also applicable to solution heat treatable steels of the S.A.E. HAV, NV and VF series, nickel based alloys such as those sold under the trade designations INCONEL, WASPALLOY and NIMONIC, STELLITE and similar compositions.

Figure 1:
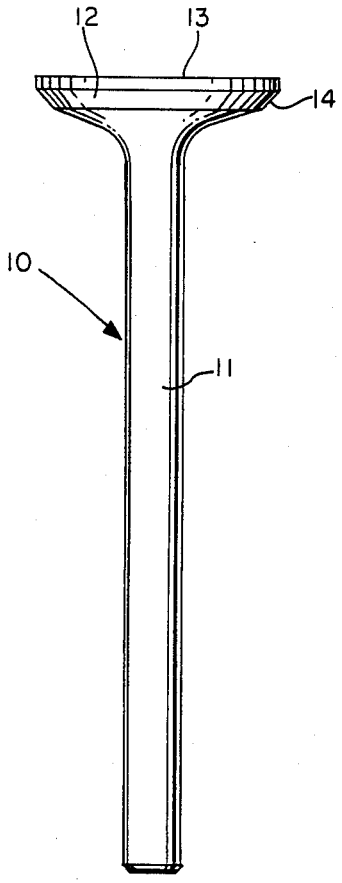
FIG. 1 is an elevational view of an engine poppet valve solution treated in accordance with the invention.

Referring to FIG. 1, reference numeral 10 designates an engine poppet valve forged from a sheared slug and heat treated in accordance with the invention. The valve 10 has a stem 11 and a head 12 which includes a combustion face 13 and a seat face 14. In accordance with the invention, the portion of the head 12 adjacent the combustion face 13 has a coarse grain size selected to provide optimum high temperature fatigue and creep strengths. The portion of the head 12 adjacent the seat face 14 and the stem 11 have a fine grain size selected to provide optimum low temperature toughness and hot hardness. It is to be understood that the cross-hatching of the valve 10 in FIG. 1 is intended to show the fine grain structure adjacent the seat face and not a seat facing applied to the head.

The rapid selective solution treatment of the valve 10 is carried out in a radiant heating furnace as disclosed in the above-referenced U.S. Pat. No. 4,547,229. As described in this patent, the radiant heating system permits heat treating the valve heads to a temperature level of 1205° C.–1277° C. (2200° F.–2350° F.), thus permitting time at temperature to be only a matter of minutes to achieve the desired grain size. The radiant heat treating furnace includes a rotating hearth in the form of a belt and carrier tubes which are enmeshed in resilient ceramic fiber insulation mounted on the belt. The valves are held upright in the carrier tubes so that the valve heads are transported below the globars in the furnace chamber.

Figure 2:
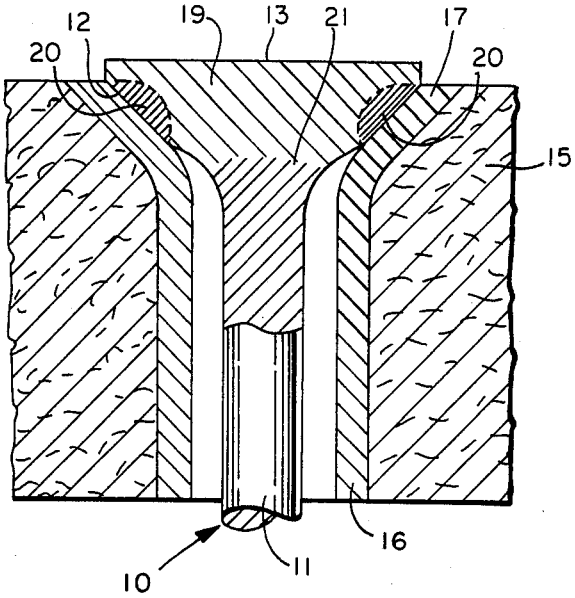
FIG. 2 is a fragmentary, diagrammatical view illustrating apparatus for carrying out the process of the invention.

In FIG. 2 the resilient ceramic fiber insulation on the continuous belt of the radiant heating furnace is designated by reference numeral 15, and the carrier tubes, only one of which is shown, enmeshed in the insulation 15 are designated by reference numeral 16. The carrier tubes 16 are made of a material having good thermal conductivity so that the tubes serve as heat sinks. The material of the tubes 16 should also be heat and corrosion resistant with a melting temperature above the solution heat treating temperatures of the furnace. Suitable heat resistant metals include nickel, chromium and cobalt based alloys and the like. Examples are an alloy consisting essentially of 45% Fe, 36% Ni, 19% Cr and about 0.05% C; and an alloy consisting essentially of 18% Fe, 25% Cr, 3% Mo, 3% Co, 1.25% Si, 1.5% Mn, 0.05% C, 3% W, and the balance Ni. Alternatively, the carrier tubes 16 can be made of a ceramic material such as silicon carbide and the like having good thermal conductivity and impact resistance.

As shown, the carrier tubes 16 have flared end portions 17 which open on the upper surface of the insulation 15. In use a valve 10 is mounted in each carrier tube 16 so that the valve seat 12 rests snugly against the inside surface of the flared end 17. The combustion surface 13 of the valve head is exposed above the insulation at 15 and the stem 11 extends down through the tube 16.

As the valves are moved through the furnace chamber in a continuous manner, the exposed heads are rapidly heated to produce a coarse grain size in the area 19 adjacent the combustion face 13 which is consistent with high temperature fatigue and creep strengths. At the same time, the stems 11 are shielded by the tubes 16 to maintain the fine grain size from forging. Since the flared ends 17 of the tube 16 contact the seat face 12 of the valve head, the temperature of the valve material in the area 20 adjacent to the seat face 12 is prevented from getting high enough to result in significant grain growth. A transition zone 21 exists between the coarse grain area 19 of the head and the fine grain in the stem 11.

In a typical heat treating process carried out in accordance with the invention, the coarse grain size of the head adjacent to its combustion face is in a range from about ASTM 2 to 5. The fine grain size in the head adjacent the seat face 12 and in the stem is typically ASTM 8 or finer.

It will be apparent from the foregoing that the invention achieves the objective of providing a poppet valve in which the microstructure varies from location to location to match the stresses, temperatures and other operating conditions experienced in service. The invention is particularly characterized by a fine grain size in the valve head area adjacent to the seat face, while the remainder of the valve has the optimum microstructure described in U.S. Pat. No. 4,547,229.

I claim:

1. A solution heat treated poppet valve comprising a forged head and a forged stem, said heat having a combustion face facing away from the stem and having a seat face defined on an annular surface tapering inwardly from a periphery thereabout towards the stem, and said valve being further characterized by a microstructure provided by conditions imposed thereupon during solution heat treating effective to provide:

(i) a fine grain size of about ASTM 8 or finer in the stem for low temperature toughness and wear resistance;

(ii) a coarse grain size of about ASTM 2 to 5 in the head adjacent the combustion face for high temperature creep and fatigue strength;

(iii) a transition zone in the head between the coarse grain size adjacent the combustion face and the fine grain size in the stem; and (iv) a fine grain size of about ASTM 8 or finer in the portion of the head adjacent the seat face for high temperature hardness and corrosion resistance.

2. The valve of claim 1 wherein the conditions imposed during solution heat treating comprise providing a heat shield about the stem adapted to shield the stem from the solution heat treating temperature and thereby maintain the forged grain size therein and contacting the seat face with a heat conductive member to provide a heat sink therefore effective to prevent significant grain growth in the portion of the head adjacent the seat face whilst exposing the combustion face to solution heat treating temperatures.

3. A method of making poppet valves comprising the steps of:

(a) forging a poppet valve from a sheared slug, said valve having a head and a stem with the head having a combustion face facing away from the stem and having a seat face defined on an annular surface tapering inwardly from a periphery thereabout towards the stem;

(b) providing a shield about the valve stem effective to shield the stem from the solution heat treating temperatures and thereby maintain the forged grain size therein and contacting the seat face with a heat conductive member to provide a heat sink therefore effective to prevent significant grain growth in the portion of the head adjacent the seat face; and (c) solution heat treating the valve of step (b) from its combustion face at a temperature and for a time predetermined to provide the valve with;

(i) a coarse grain size of about ASTM 2 to 5 in the head adjacent the combustion face;

(ii) a fine grain size of about ASTM 8 or finer in the stem for low temperature toughness and wear resistance;

(iii) a transition zone in the head between the coarse grain size adjacent the combustion face and the fine grain size in the stem; and (iv) a fine grain size of about ASTM 8 or finer in the head adjacent the seat face for high temperature hardness and corrosion resistance.

4. The method of claim 3 wherein the solution heat treating of step (c) is carried out by radiant heating in a continuous manner.

5. The method of claim 3 wherein the shield and the heat sink of step (b) are both provided by a carrier tube made from a heat conductive material, said tube adapted to receive the stem thereinto to provide the heat shield thereabout and having a flared end adapted to contact the seat face to provide the heat sink therefore.

* * * * *